US009754750B2

(12) United States Patent
Cai et al.

(10) Patent No.: US 9,754,750 B2
(45) Date of Patent: Sep. 5, 2017

(54) MAGNETIC LATCHING RELAY OF PARALLEL TYPE MAGNETIC CIRCUIT

(71) Applicant: Xiamen Hongfa Electroacoustic Co., Ltd., Fujian (CN)

(72) Inventors: Wenzhi Cai, Fujian (CN); Zhonghua Tan, Fujian (CN); Hongjiang Cao, Fujian (CN); Jinqiang Liu, Fujian (CN)

(73) Assignee: Xiamen Hongfa Electroacoustic Co., Ltd., Fujian (CN)

( * ) Notice: Subject to any disclaimer, the term of this patent is extended or adjusted under 35 U.S.C. 154(b) by 0 days.

(21) Appl. No.: 14/911,592

(22) PCT Filed: Jul. 22, 2014

(86) PCT No.: PCT/CN2014/082702
§ 371 (c)(1),
(2) Date: Feb. 11, 2016

(87) PCT Pub. No.: WO2015/021847
PCT Pub. Date: Feb. 19, 2015

(65) Prior Publication Data

US 2016/0196942 A1 Jul. 7, 2016

(30) Foreign Application Priority Data

Aug. 14, 2013 (CN) ..... 2013 1 0353686
Aug. 14, 2013 (CN) ..... 2013 1 0353982
Aug. 16, 2013 (CN) ..... 2013 1 0359111

(51) Int. Cl.
*H01H 51/01* (2006.01)
*H01H 50/40* (2006.01)
*H01H 51/22* (2006.01)
*H01H 50/44* (2006.01)

(52) U.S. Cl.
CPC ..... *H01H 51/01* (2013.01); *H01H 50/40* (2013.01); *H01H 51/2236* (2013.01); *H01H 2050/446* (2013.01)

(58) Field of Classification Search
CPC .. H01H 2050/446; H01H 50/40; H01H 51/01; H01H 51/2236
See application file for complete search history.

(56) References Cited

U.S. PATENT DOCUMENTS 3,581,260 A * 5/1971 Andreis ..... H01F 5/02 335/297
5,864,271 A 1/1999 Mader

FOREIGN PATENT DOCUMENTS

| | | |
|---|---|---|
| CN | 102163519 | 8/2011 |
| CN | 102881520 | 1/2013 |
| CN | 103426688 | 12/2013 |
| CN | 103426690 | 12/2013 |
| CN | 103436687 | 12/2013 |

* cited by examiner

*Primary Examiner* — Ramon M Barrera
(74) *Attorney, Agent, or Firm* — McDonnell Boehnen Hulbert & Berghoff LLP

(57) ABSTRACT

A magnetic latching relay of a parallel type magnetic circuit, forming two parallel permanent magnetic circuits on the permanent magnetic circuit of a relay; one of the permanent magnetic circuits is used to provide adequate attraction to an armature, so that permanent magnetic attraction can achieve a balance of applied forces with the counter-force provided by a movable spring, so as to realize relay bistability or state transition more stably.

16 Claims, 12 Drawing Sheets

MAGNETIC LATCHING RELAY OF PARALLEL TYPE MAGNETIC CIRCUIT

TECHNICAL FIELD

The present disclosure generally relates to a relay, and more particularly, to a magnetic latching relay with a parallel-type magnetic circuit.

BACKGROUND

A relay is an automatic switch device having isolation function, widely applied in communication, automobiles, automatic control, household appliances and other fields, and is one of the most important control devices.

Due to demands in energy preservation and environment protection, magnetic latching relays are applied to ever wide areas. Common relays require to be developed with magnetic latching features. Generally, for a typical clap-type relay, an iron core (or an iron yoke) is divided into two parts. A permanent magnet is connected between the two parts, to form a series-type magnetic circuit. Upon excitation of a coil, the magnetic circuit is closed, and a magnetic force generated by the permanent magnet can keep an armature in closed state. FIG. 1 is a schematic structural diagram of a magnetic circuit of a magnetic-latching-type electromagnet relay in the prior art. As shown in FIG. 1, the magnetic circuit of the electromagnet relay includes a spring sheet 101 (which can form a part of an output circuit of the relay), an armature 102, an iron yoke 103, an iron core 104, a coil 105 and a permanent magnet 106. The iron core 104 passes through the coil 105. The permanent magnet 106 is fixed between the iron core 104 and the iron yoke 103. The armature 102 and the spring sheet 101 are riveted together in advance, and riveted onto the iron yoke 103. The permanent magnet 106 generates a permanent magnetic circuit which starts from an N pole of the permanent magnet, passes through the iron core 104, an air gap, the armature 102, the iron yoke 103, reaches an S pole of the permanent magnet. Upon excitation, the coil 105 generates a magnetic field which passes through the iron core 104, the air gap, the armature 102, the iron yoke 103 and the S-N of the permanent magnet. When the permanent magnet filed and the magnetic field generated by the coil is in the same direction, the magnetic forces will add to each other to form a force which overcomes the counter force of the spring sheet 101, so as to cause the armature 102 and the iron core 104 to attract each other. After the excitation of the coil 105 stops, the magnetic field generated by the coil will disappear, and the permanent magnetic field will provide a retention force to keep the armature 102 and the iron core 104 in the attracted state. When a reverse current flows through the coil, the coil 105 generates a magnetic field which passes through the iron core 104, the N-S of the permanent magnet, the iron yoke 103 and the armature 102. Thus, the magnetic field generated by the coil is opposite to the direction of the permanent magnetic field, and weakens the permanent magnetic force. Under the "cooperation" of the counter force of the spring sheet 101, the spring sheet 101 brings the armature 102 to be reset.

Such a series-type magnetic circuit has the following defects.

1. The permanent magnet always causes the armature to be attracted to the iron core, and even though the spring sheet has a large counter force, but a pressure on the contact point at a normal-close terminal of the product is relatively small. Therefore, load capability of the fixed closed terminal is poor, and the product relay has a poor resistance against impact and vibration.

2. After the coil is excited for reset, the magnetic force of the permanent magnet still generates a strong attraction force to the armature. Therefore, it requires a large reset force to reset the armature to reset to a released state. If the magnetic force does not match the reset force, the coil may require a small setting voltage and a large resetting voltage, or the coil may fail to be reset.

SUMMARY

The objective of the present disclosure is to overcome the deficiency in the related art. In one aspect, the objective is to provide a magnetic latching relay with a parallel-type magnetic circuit in which two parallel permanent magnetic paths are formed, one of the paths is for providing a suitable attraction force to the armature, so as to keep balance with a counter force provided by a movable spring sheet and to achieve bistability or state switching more stably.

In another aspect, the objective of the present disclosure is to provide a magnetic latching relay with a parallel type magnetic circuit in which a magnetic isolation recess is provided on the iron yoke and a cut is provided on the pole shoe of the iron core, to adjust the retention force generated by the iron core to the armature at the position of the armature, thus keeping balance between the magnitudes of resetting voltage and the setting voltage of the magnetic latching relay as much as possible.

In still another aspect, the objective of the present disclosure is to improve the structure of the coil rack and the pole shoe of the iron core. Thus, on one hand, it can increase the creepage distance between the iron core and the fixed spring sheet, preventing electrical accidents caused by unwanted conduction of the movable contact point and the fixed contact point due to accumulation of metal spatters of the contact points. On the other hand, it can significantly improve the impact resistance of the relay.

In yet still another aspect, the objective of the present disclosure is to improve the structure of the bobbin of the coil rack, to effectively isolate the first circle of an enameled wire and the last circle of the enameled wire, avoiding defects in the related art which are caused by placing the first circle of the enameled wire and the last circle of the enameled wire together.

The technical solutions of the present disclosure for solving the technical problems are as follows.

A clapper relay, including a magnetic circuit portion and a movable spring portion, characterized in that, the magnetic circuit portion includes an iron core, an armature, an iron yoke, a permanent magnet, a magnetic conductor member, a coil and a coil rack; the iron yoke is L shaped, formed by a first yoke parallel to the iron core and a second yoke perpendicular to the iron core; the coil is wound on the coil rack, the iron core passes through the coil rack, a lower end of the iron core is secured to the second yoke; the armature is movably mounted to a hinge portion of the iron yoke, an air gap is formed between one end of the armature and an upper end of the iron core; one end of the magnetic conductor member is connected to the first yoke, the other end of the magnetic conductor member is connected to first yoke through the permanent magnet; the movable spring portion includes a movable spring sheet and a movable contact point, the movable spring sheet formed with a first side and a second side, an elastically bendable angle is formed between the first side and the second side; the armature is secured to the second side, the first yoke is secured to the first side, the armature is flexibly connected to the first yoke via the movable spring sheet; the movable contact point is secured to the second side, wherein the permanent magnet and the magnetic conductor member, the first yoke, the second yoke, the iron core and the armature form two parallel permanent magnetic paths; the coil and the iron core form a control magnetic path, to control the opening and closing of the air gap; the permanent magnetic paths provide a force to maintain the air gap to be closed; the movable spring sheet provides a counter force to maintain the air gap to be opened.

According to an embodiment of the present disclosure, at least one magnetic isolation portion is provided on the first yoke which is between a joint of the first yoke and the permanent magnet and a joint of the first yoke and the magnetic conductor member, the magnetic isolation portion is configured to increase a magnetic resistance of the magnetic circuit portion, and to adjust balance between magnitudes of setting voltage and resetting voltage of the relay by adjusting an opening size of a magnetic isolation recess.

According to an embodiment of the present disclosure, an upper end of the iron core is provided with a pole shoe, a cut is provided at a side of the pole shoe, a size of the cut and/or the opening size of the magnetic isolation recess can be adjusted to regulate balance between magnitudes of a setting voltage and a resetting voltage of the relay.

According to an embodiment of the present disclosure, one end of the magnetic conductor member is provided with a contact surface for contacting the first yoke.

According to an embodiment of the present disclosure, the contact surface of the magnetic conductor member is provided with a boss for positioning with the first yoke, the first yoke is provided with a hole for fitting with the boss of the magnetic conductor member; the boss of the magnetic conductor member is fitted in the hole of the first yoke, and secured thereto via rivet or welding.

According to an embodiment of the present disclosure, the permanent magnet is secured to the other end of the magnetic conductor member, and the other end of the magnetic conductor member is provided with a bulge for securing the permanent magnet.

According to an embodiment of the present disclosure, the relay further includes a fixed spring portion, the fixed spring portion includes a fixed spring sheet and a fixed contact point secured on the fixed spring sheet; an upper end plate of the coil rack extends to a side where a mounting portion is disposed, the fixed spring sheet is mounted in the mounting portion, the movable contact point is mounted at a position in the mounting portion where matches with the position of the fixed contact point; at least one shielding wall is provided on the coil rack and between the through holes and the mounting portion, to separate a pole shoe at the through hole of the coil rack and the fixed spring sheet at the mounting portion.

According to an embodiment of the present disclosure, the shielding wall is disposed close to the through hole, and corresponding to the armature secured to the movable spring sheet, a height of the shielding wall is not lower than a bottom of the armature when the relay is reset, in order to prevent the armature from moving to a direction where the movable contact point contacts the fixed contact point.

According to an embodiment of the present disclosure, there are provided two shielding walls, and a groove is formed between the two shielding walls for collecting spatters of the contact points, wherein one of the shielding walls is disposed close to the through hole, and corresponding to the armature secured to the movable spring sheet, a height of the shielding wall is not lower than a bottom of the armature when the relay is reset, in order to prevent the armature from moving to a direction where the movable contact point contacts the fixed contact point.

According to an embodiment of the present disclosure, the shielding wall is integrated with the coil rack.

According to an embodiment of the present disclosure, the coil rack includes a bobbin, one end of the bobbin is connected to a lower terminal plate, the other end of the bobbin is connected to an upper terminal plate, a first pin, a second pin and a third pin are respectively mounted on the lower terminal plate; a groove for guiding an enameled wire is provided at an inner side of the lower terminal plate which is between the bobbin and the second pin, one end of the groove is connected to the bobbin, and the other end of the groove leads to the second pin.

According to an embodiment of the present disclosure, a boss is provided at an inner side of the lower terminal plate which extends from the bobbin to the second pin, a support wall is provided at a side of the boss, and the groove for guiding an enameled wire is surrounded and thus formed by the support wall and the boss.

According to an embodiment of the present disclosure, an inclined plate is provided at an inner side of the lower terminal plate, the inclined plate is gradually inclined in a direction from the bobbin to the second pin; the boss and the support wall are respectively disposed at the middle of the inclined plate and a side of the inclined plate.

According to an embodiment of the present disclosure, a first cover plate which can press and seize the enameled wire is mounted at the inner side of the lower terminal plate and between the first pin and the bobbin.

According to an embodiment of the present disclosure, neither of an upper surface of the boss and an upper surface of the support wall is higher than an upper surface of the first cover plate.

According to an embodiment of the present disclosure, a second cover plate which can press and seize the enameled wire is mounted at the inner side of the lower terminal plate and between the third pin and the bobbin.

According to an embodiment of the present disclosure, neither of the upper surface of the boss and the upper surface of the support wall is higher than an upper surface of the second cover plate.

It can be seen from the above description of the present disclosure that, compared with related art, the present disclosure has the following advantageous effects.

According to an embodiment, due to the effect of the magnetic conductor member, the magnetic flux generated by the permanent magnet is divided into two paths and both of the two paths of magnetic fluxes are adjustable. Thereby, it can solve the problem that in the series-type magnetic circuit, there is only one path which cannot be adjusted, and the permanent magnet in the resetting position will keep a large attraction force to the armature and reduce the pressure on the contact points of the normal-close terminal and weaken the load capability of the fixed closed terminal and the product relay has a poor resistance against impact and vibration.

According to an embodiment, the first yoke is provided with a magnetic isolation recess for increasing the magnetic resistance of the magnetic circuit, and a portion of the pole shoe of the iron core is cut off. The size of area of the cut (the portion cut off) can be adjusted to, together with the magnetic isolation recess, regulate the balance between the magnitudes of the setting voltage and resetting voltage of the relay. The size of the magnetic isolation recess of the iron yoke can be adjusted to regulate the balance between the magnitudes of the setting voltage and resetting voltage of the relay. However, the magnetic isolation recess cannot be increased infinitely. That is, the magnetic conduction cross sectional area at either side of the magnetic isolation recess cannot be reduced infinitely. Therefore, the magnitudes of the setting voltage and the resetting voltage of the relay cannot be regulated without limit. For a magnetic latching relay, it is generally desirable to make the resetting voltage to be approximate to the setting voltage as much as possible. Therefore, in order to increase the resetting voltage, in the prevent disclosure, a portion of the pole shoe of the iron core is cut off. According to a magnetic circuit principle, the smaller the area of the pole shoe of the iron core is, the larger the retention force (the magnetic attraction force) on the armature when the armature is at the setting position is, and the larger the resetting voltage required is. Accordingly, the magnitudes of the resetting voltage and the setting voltage can be balanced (to make the resetting voltage to be approximate to the setting voltage in the value) as much as possible.

According to an embodiment, a shielding wall is provided on the coil rack between the fixed spring sheet and the iron core. After the movable contact point and the fixed contact point are burned, metal spatters of the movable contact point and the fixed contact point can be blocked by the shielding wall, to prevent the metal spatters from drifting from the contact points to the iron core. A groove formed between the two shielding walls and a region between the shielding wall and the fixed contact point can also be configured to collect the metal spatters of the contact points. Thereby, the creepage distance between the movable contact point and the fixed contact point as well as the dielectric Strength can be improved, and it can effectively prevent electrical accidents caused by unwanted conduction of the movable contact point and the fixed contact point due to accumulation of metal spatters of the contact points. The shielding wall is disposed close to the through hole, and corresponding to the armature which is secured to the movable spring sheet. The height of the shielding wall is not lower than the bottom of the armature when the relay is reset. When the relay is subject to an impact in a length direction, the armature will move toward the contact points. Due to the presence of the shielding wall, the armature is limited in the length direction. Thus, the armature and the movable contact point will not displace from normal positions due to the impact, significantly improving the impact resistance of the relay.

According to an embodiment, a groove for guiding the enameled wire is surrounded and thus formed by a boss and a support wall. The bottom of the groove is an inclined plate. One end of the groove is connected to the bobbin, one end of the groove leads to the second pin. Thus, in winding the first circle of the outer circles of the enameled wire, the enameled wire is placed on the inclined plate. In winding the last circle of the outer circles of the enameled wire, due to the effect of the boss and the support wall, the last circle of the enameled wire can be held up, to form an air gap between the first circle of the enameled wire and the last circle of the enameled wire, thus avoiding an unfavorable situation of the first circle and the last circle being directly placed together in winding the out circles.

DETAILED DESCRIPTION

Figure 1:
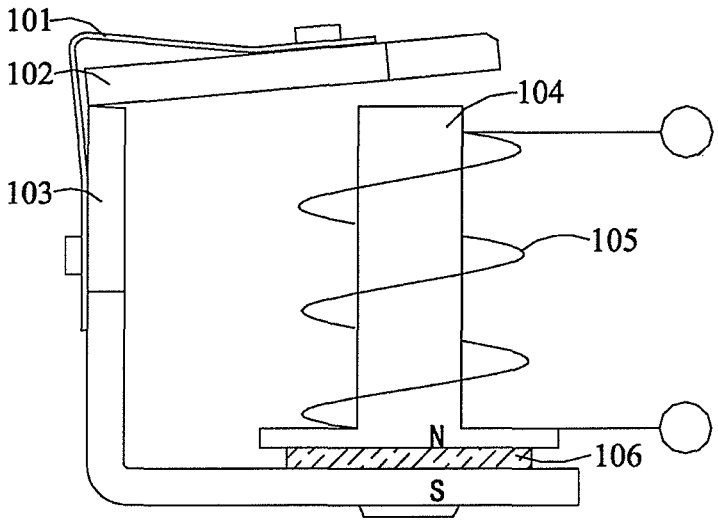
Fig.1 (Prior Art)
FIG. 1 is a schematic structural diagram of a magnetic circuit portion of a magnetic-latching-type electromagnet relay in the prior art.

Representative embodiments showing characteristics and advantages of the present disclosure will be described in detail in the following description. It should be understood that, the present disclosure can be varied with various embodiments without departing from the scope of the present disclosure. The description and the illustration are merely for explanation, rather than for limitation of the present disclosure.

Terms representing orientations, such as upper, lower, top, bottom and the like mentioned in the present disclosure are merely for illustrating relative positions between components, and not for limitation of specific assembly orientation of the components in the present disclosure.

As shown in FIGS. 2-9, an embodiment of the present disclosure provides a magnetic latching relay with a parallel type magnetic circuit, including a magnetic circuit portion 1, a movable spring portion 2, a fixed spring portion 3 and a base 4. Wherein the magnetic circuit portion 1 includes an iron core 11, an armature 12, an iron yoke 13, a permanent magnet 14, a magnetic conductor member 15, a coil rack 16 and an enameled wire 17. The movable spring portion 2 includes a movable spring sheet 21 and a movable contact point 22. The fixed spring portion 3 includes a fixed spring sheet 31 and a fixed contact point 32.

Figure 2:
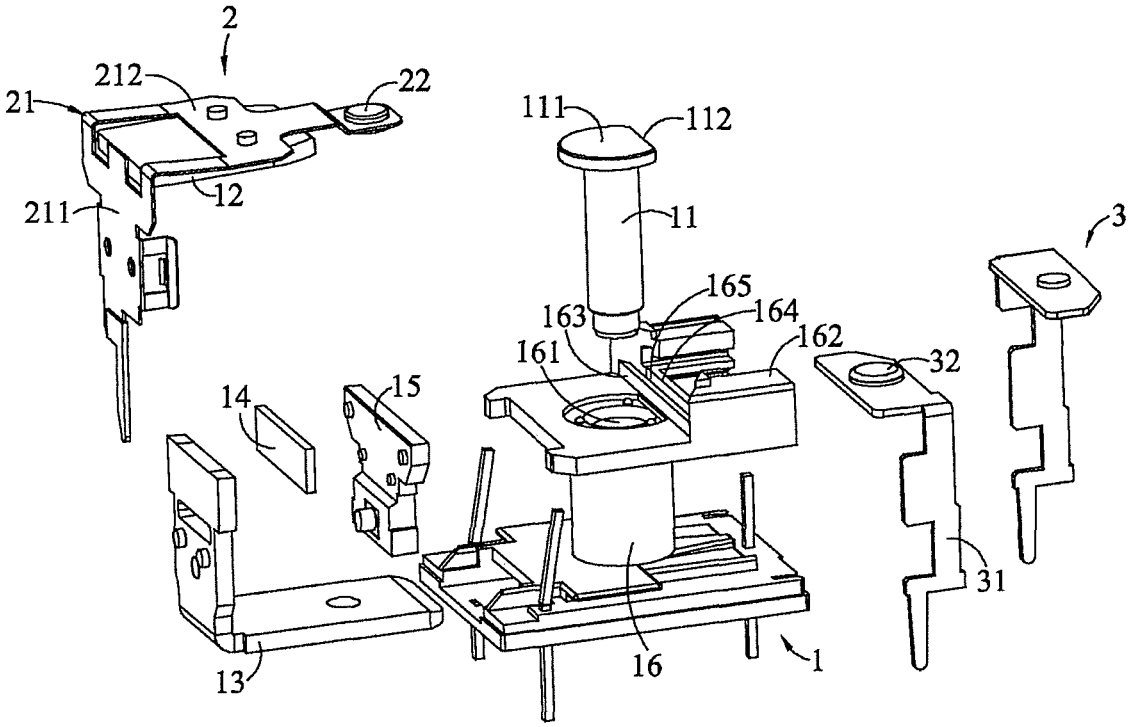
FIG. 2 is an exploded view of the configuration according to an embodiment of the present disclosure.
Figure 3:
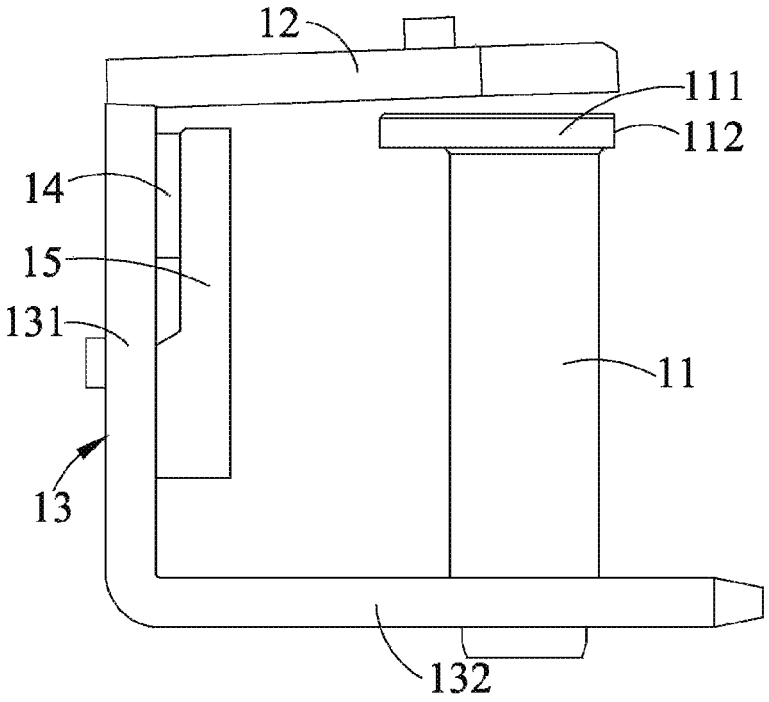
FIG. 3 is a schematic structural diagram of a magnetic circuit portion according to an embodiment of the present disclosure.
Figure 4:
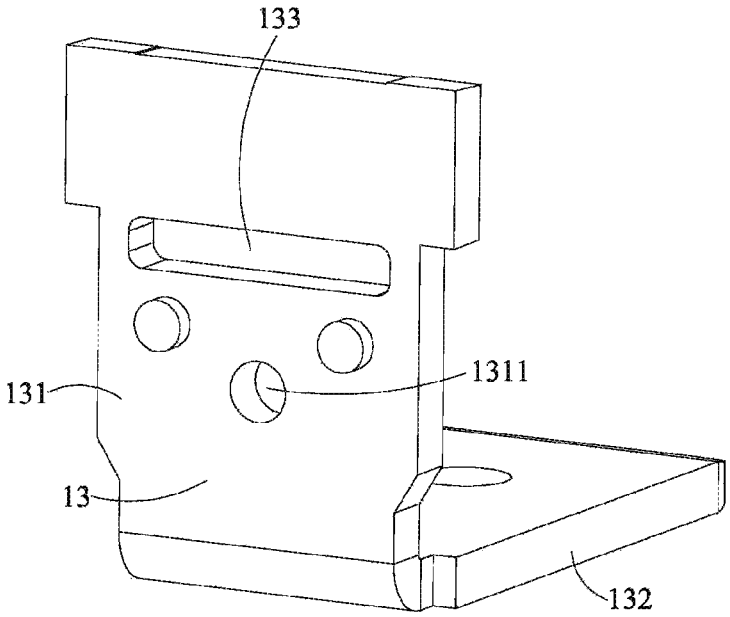
FIG. 4 is a schematic structural diagram of an iron yoke of the magnetic circuit portion according to an embodiment of the present disclosure.

As shown in FIGS. 2 and 3, the iron yoke 13 is L shaped, formed by a first yoke 131 parallel to the iron core and a second yoke 132 perpendicular to the iron core. An upper end of the first yoke 131 forms a hinge portion of the iron yoke 13 (a "hinge portion" refers to a contact portion of the iron yoke contacting with the armature rotating around the iron yoke). The armature 12 can rotate around the hinge portion of the iron yoke. The enameled wire 17 is wound on the coil rack 16, and the coil rack 16 is mounted on the base 4. In the present embodiment, the coil rack 16 is integrally formed with the base 4. The coil rack 16 is provided with a through hole 161 along a vertical direction. The iron core 11 is mounted in the through hole 161 of the coil rack. The iron core 11 is provided at an upper end thereof with a pole shoe 111, and the iron core 11 is secured to the second yoke 132 at its lower end. The armature 12 is connected to the iron yoke 13 via the movable spring sheet 21. The movable spring sheet 21 is formed with a first side 211 and a second side 212. An elastically bendable angle is formed between the first side 211 and the second side 212. The armature 12 can be secured to the second side 212 through a rivet. The first yoke 131 can be secured to the first side 211 through a rivet. The armature 12 is flexibly connected to the first yoke 131 via the movable spring sheet 21. The movable contact point can be secured to an end portion of the second side 212 which extends beyond the armature 12. The second side 212 of the movable spring sheet is secured to the armature 12 and fitted on the upper side of the pole shoe 111 of the iron core, and the armature 12 is thus mounted at the hinge portion of the iron yoke.

The magnetic conductor member 15 has one end connected with the first yoke 131, and the other end connected to the first yoke 131 via the permanent magnet 14. A magnetic isolation recess 133 is provide between a conjunction of the first yoke 131 and the permanent magnet 14 and the first yoke 131 and the magnetic conductor member 15. The magnetic isolation recess 133 is for increasing the magnetic resistance of the magnetic circuit, and a size of the magnetic isolation recess 133 can be adjusted to adjust balance between the setting voltage and resetting voltage of the relay. The pole shoe 111 has a side provided with a cut 112. Combined with the magnetic isolation recess 133, a size of the cut 112 can be adjusted to adjust the balance between the setting voltage and resetting voltage of the relay. Now the drawing only shows one magnetic isolation recess 133, however two magnetic isolation recesses 133 can be implemented as long as a cross section area of solid portion of the first yoke 131 can be adjusted. The magnetic isolation recess 133 can be replaced with other magnetic isolation configuration, such as a pillar member or the like.

Figure 9:
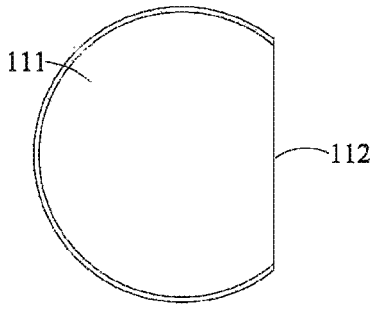
FIG. 9 is a top view of an iron core of the magnetic circuit portion according to an embodiment of the present disclosure.

In the present embodiment, the cut 112 of the pole shoe 111 is a full circular shape with one portion cut off (as shown in FIG. 9), the full circular shape being symmetric with respect to the central axis of the iron core. However, alternatively, the cut of the pole shoe can be a full rectangle with one portion cut off, the full rectangle being symmetric with respect to the central axis of the iron core. The cut 112 of the pole shoe 111 is disposed toward a direction in which the movable contact point and the fixed contact point are to be attracted to each other (as shown in FIG. 2). Thereby, a creepage distance between the iron core and the fixed spring sheet can be increased.

A creepage distance is a "distance" measured along an insulated surface between two conductive components.

Figure 6:
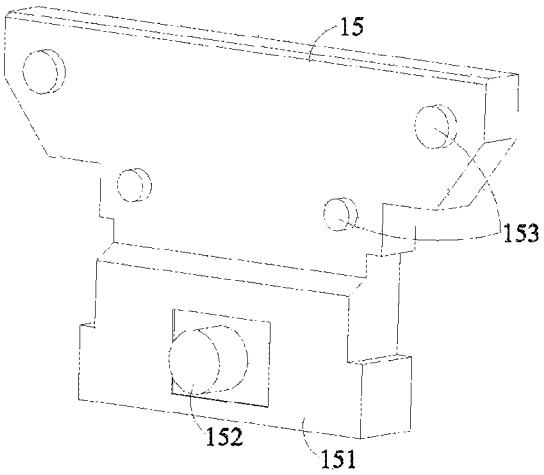
FIG. 6 is a schematic structural diagram of a magnetic conductor member of the magnetic circuit portion according to an embodiment of the present disclosure.
Figure 7:
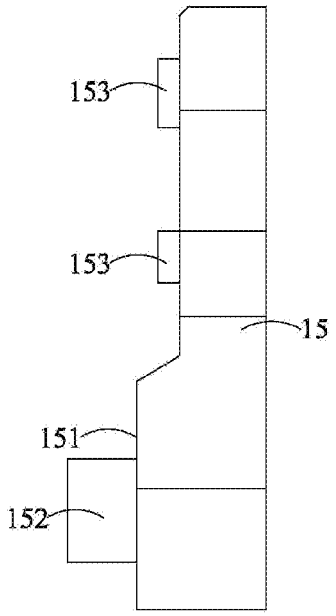
FIG. 7 is a side view of the magnetic conductor member of the magnetic circuit portion according to an embodiment of the present disclosure.
Figure 8:
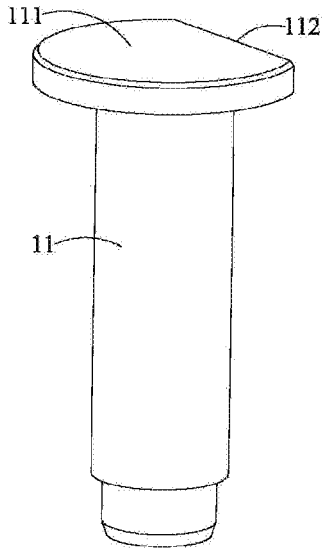
FIG. 8 is a schematic structural diagram of an iron core of the magnetic circuit portion according to an embodiment of the present disclosure.

As shown in FIGS. 3, 6 and 7, the magnetic conductor member 15 is at one end provided with a contact surface 151 for contacting the first yoke 131. The contact surface 151 of the magnetic conductor member is provided with one or more bosses 152 for positioning of the first yoke. The first yoke 131 is provided thereon with holes 1311 fitted with the bosses of the magnetic conductor member. The bosses 152 of the magnetic conductor member is fitted within the holes 1311 of the first yoke 131, and secured with them via a rivet or weld. The permanent magnet 14 is secured to the other end of the magnetic conductor member 15. The magnetic conductor member is provided at the other end with bosses 153 for securing the permanent magnet.

FIGS. 10-13 are schematic circuit diagrams of the relay when the relay is respectively powered off, powered with a setting voltage, when the coil is powered with a resetting voltage. $\Phi m1$, $\Phi m2$ denote magnetic fluxes (referred to as permanent magnet fluxes, generally represented by $\Phi m$) generated by the permanent magnet 14. The paths passed by the permanent magnet fluxes are respectively referred to as a first magnetic path A1 and a second magnetic path A2. $\Phi c1$, $\Phi c2$ denote magnetic fluxes (referred to as control magnet fluxes, generally represented by $\Phi c$) generated by current in the coil, and the path passed by the control magnet fluxes is referred to as a third magnetic path A3. Wherein, $\Phi c1$ is a magnetic flux generated by current of the coil under a setting voltage, and $\Phi c2$ is a magnetic flux generated by current of the coil under a resetting voltage. $\delta 2$ denotes an operation air gap, and F2 denotes an electromagnetic attraction force (generally represented by F) applied on the armature at the air gap $\delta 2$. The magnetic circuit has two stable states, that is, the armature 12 being at the setting position or at the resetting position.

Figure 10:
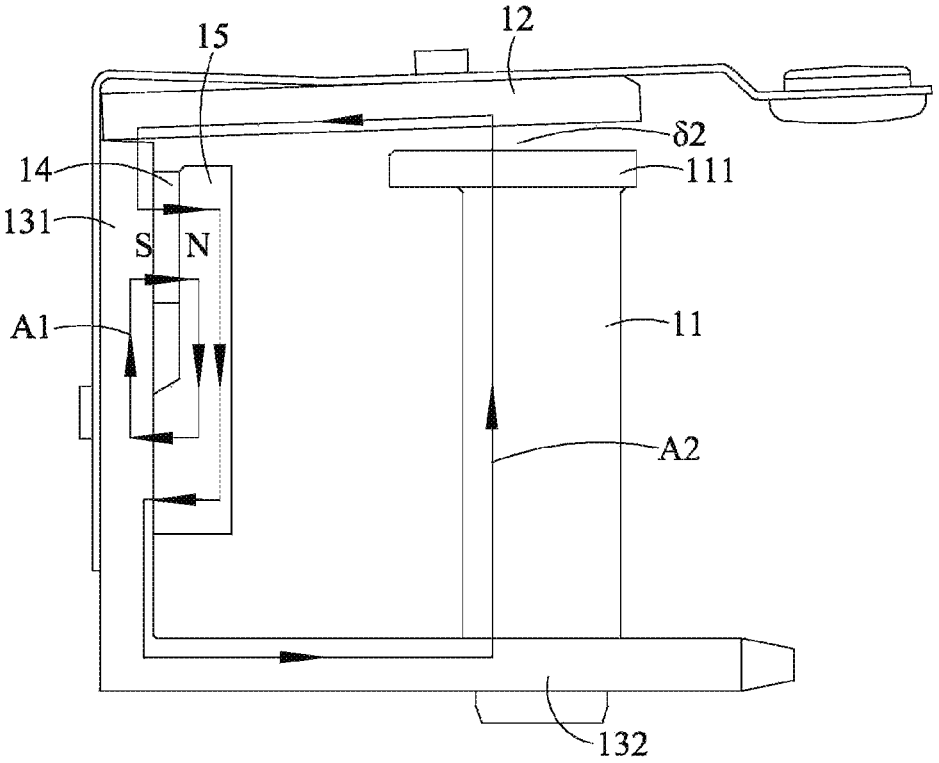
FIG. 10 is a schematic circuit diagram of the magnetic circuit portion according to an embodiment of the present disclosure, in a resetting state and when the coil is powered off.

When the armature 12 is in the resetting state (the armature 12 is at an opened position, and the coil is not supplied with current) as shown in FIG. 10, due to the effects of the magnetic conductor member 15 and the magnetic isolation recess 133, the magnetic flux generated by the permanent magnet 14 passes through paths of the first magnetic path A1 and the second magnetic path A2 as shown in the figure. The magnetic fluxes denoted by Φm1 and Φm2 are parallel. On the second magnetic path A2, due to the influence of the air gap δ2, Φm2 has a small effect. Therefore, at this time, the armature 12 is subject to a weak electromagnetic attraction force F2 under the effect of Φm2, which is smaller than a counter force F1 applied by the movable spring sheet 21 on the armature 12, that is, F1>F2. Then, under the counter action of the counter force of the movable spring sheet 21, the armature 12 can be stably maintained at the resetting position (i.e. the opened position). Due to the effects of the magnetic conductor member 15 and the magnetic isolation recess 133, the magnetic flux generated by the permanent magnet 14 are divided into magnetic fluxes Φm1 and Φm2 of two paths, and the magnitudes of the magnetic fluxes Φm1 and Φm2 can be adjusted. Thereby, it can solve the problem in the series-type magnetic circuit, there is only one path which cannot be adjusted, and the permanent magnet in the resetting position will keep a large attraction force to the armature and reduce the pressure on the contact points of the normal-close terminal and weaken the load capability of the fixed closed terminal and the product relay has a poor resistance against impact and vibration.

Figure 11:
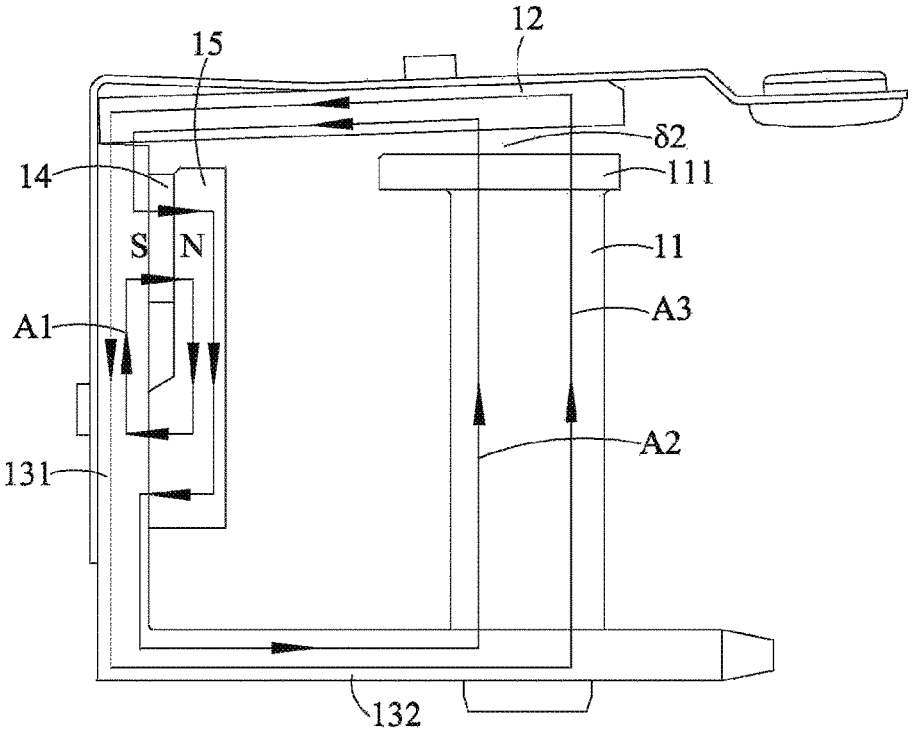
FIG. 11 is a schematic circuit diagram of the magnetic circuit portion according to an embodiment of the present disclosure, in a resetting state and when the coil is powered with a setting voltage.

As shown in FIG. 11, when a resetting pulse voltage with a certain width is applied on the coil of the relay, a control magnetic flux Φc1 generated by the coil of the relay has a direction as shown by a third magnetic path A3 in FIG. 11. At this time, the magnetic flux Φc1 generated by the coil and the magnetic flux Φm2 generated by the permanent magnet 14 have the same direction (as shown by a second magnetic path A2 in FIG. 11). This increases a composite magnetic flux at the air gap δ2. Therefore, the armature 12 is subject an increased electromagnetic attraction force F2 due to the effect of the composite magnetic flux of Φc1 and Φm2. When the electromagnetic attraction force F2 subjected by the armature 12 is larger than the counter force F1 applied by the movable spring sheet 21 on the armature 12, the armature 12 will complete an action moving from the resetting position to the setting position under the composite force of F2 and F1. Afterwards, after the operation current of the coil is powered off, the electromagnetic attraction force F2 generated by the magnetic flux Φm2 of the permanent magnet 14 is larger than the counter force F1 applied by the movable spring sheet 21 on the armature 12. Then, the armature 12 will be stably maintained in the setting position, as shown in FIG. 12.

Figure 12:
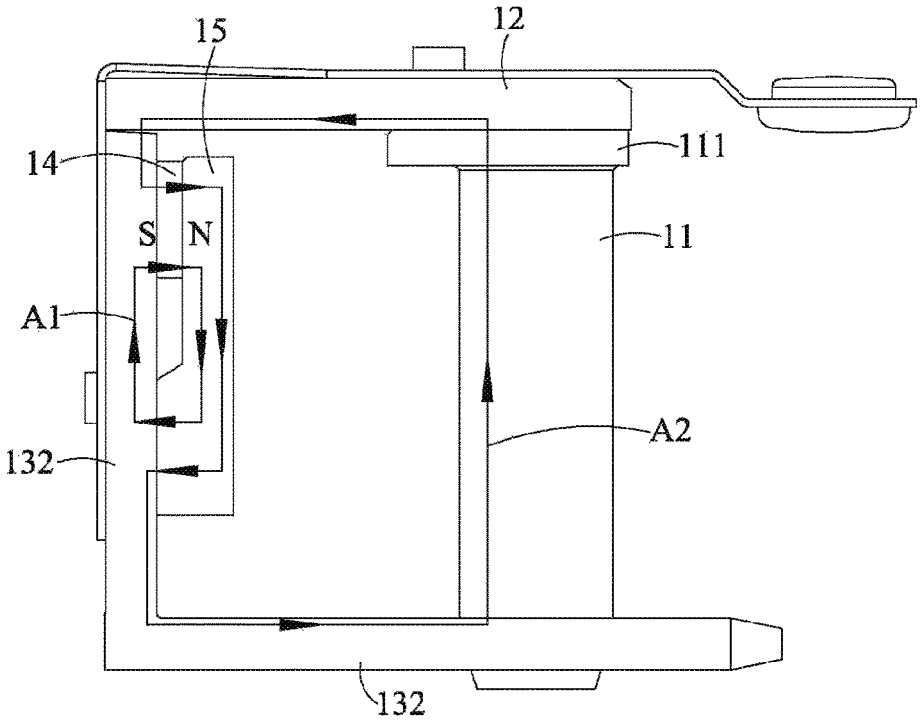
FIG. 12 is a schematic circuit diagram of the magnetic circuit portion according to an embodiment of the present disclosure, in a setting state and when the coil is powered off.
Figure 13:
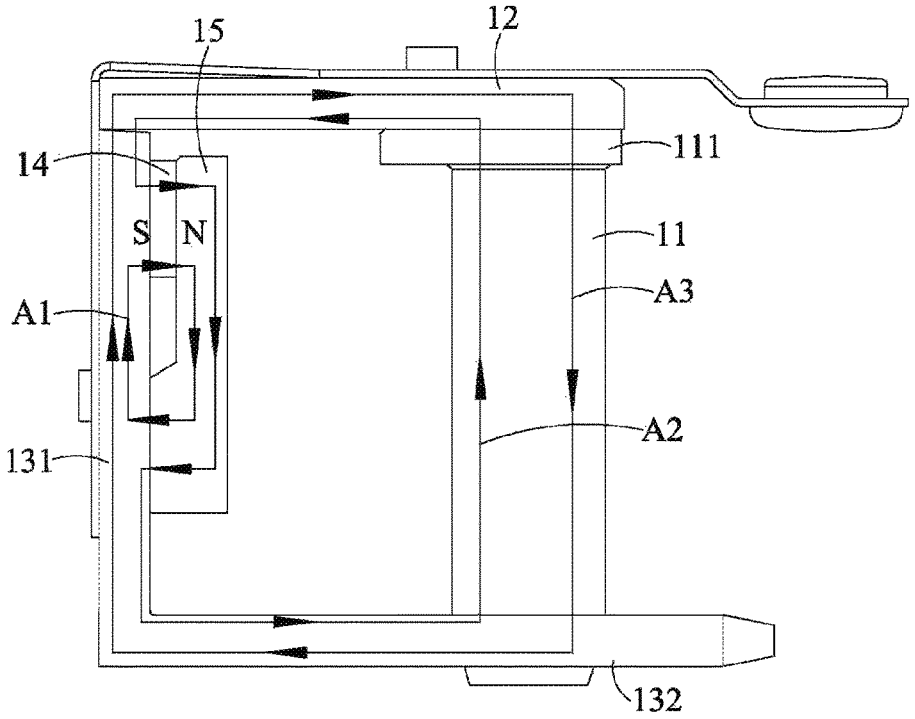
FIG. 13 is a schematic circuit diagram of the magnetic circuit portion according to an embodiment of the present disclosure, in a setting state and when the coil is powered with a resetting voltage.

When the relay is at the setting position as shown in FIG. 12, a resetting pulse voltage (opposite to the setting voltage) with a certain width is applied to the coil of the relay, a control magnetic flux Φc2 generated by the coil of the relay has a direction as shown in FIG. 13. At this time, the magnetic flux Φc2 generated by the coil and the magnetic flux Φm2 generated by the permanent magnet 14 have opposite directions (as shown by the second magnetic path A2 and the third magnetic path A3 in FIG. 13). Thereby, the magnetic flux Φm2 generated by the permanent magnet 14 is counteracted. Therefore, at this time, electromagnetic attraction force F2 subjected by the armature 12 is decreased due to the effects of Φc2 and Φm2. When the electromagnetic attraction force F2 subjected by the armature 12 is smaller than the counter force F1 applied by the movable spring sheet 21 on the armature 12, the armature 12 will complete an action moving from the setting position to the resetting position under the composite force of F2 and F1, and return to the resetting position as shown in FIG. 10.

Figure 5:
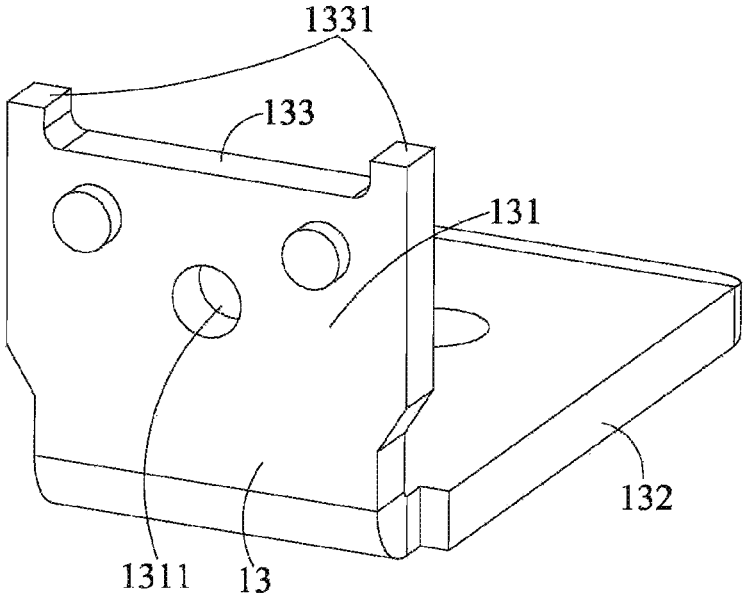
FIG. 5 is a schematic structural diagram of an iron yoke of the magnetic circuit portion according to an embodiment of the present disclosure, with one portion removed.

FIG. 12 shows magnetic fluxes of the magnetic circuit when the armature is at the setting position and the coil is powered off. The permanent magnet 14 has two paths of magnetic fluxes Φm1 and Φm2. The total flux of the permanent magnet 14 (Φmtotal)=Φm1+Φm2. By adjusting the size of the magnetic isolation recess 133, a magnetic conduction cross sectional area 1331 at either side of the magnetic isolation recess 133 of the yoke (as shown in FIG. 5) changes and thus a magnetic resistance of the first magnetic path A1 changes, to form a changed first magnetic fluxe Φm1. Since the total flux(Φmtotal) is substantially constant, and Φm2=(Φmtotal)−Φm1, when (Φm1 changes, Φm2 will change too (in an opposite direction of value variation). When Φm2 changes, the electromagnetic attraction force F2 generated by the permanent magnet 14 through the second magnetic path A2, which attracts the armature 12 on the pole shoe of the iron core, will change. That is, the retention force to keep the armature 102 against the pole shoe of the iron core changes, to solve the problem that it is hard to reset in the series-type magnetic circuit. Due to the effect of the magnetic conductor member 15 and the magnetic isolation recess 133, the magnetic flux generated by the permanent magnet 14 is divided into two paths Φm1 and Φm2, and the magnitudes of Φm1 and Φm2 can be adjusted, to solve the problem that in the series-type magnetic circuit, there is there is only one path which cannot be adjusted, causing difficulty in resetting.

When the coil of the relay is applied with a resetting pulse voltage (opposite to the setting voltage) with a certain width, the magnetic flux Φc2 generated by the coil will be counteracted by the magnetic flux Φm2 generated by the permanent magnet 14. When the composite magnetic flux (Φm2−Φc2) is reduced to a degree that the electromagnetic attraction force F2 generated by composite magnetic flux to the armature 12 is smaller than the counter force F1 applied by the movable spring sheet 21 on the armature 12, the armature 12 will complete an action moving from the setting position to the resetting position under the composite force of F2 and F1. As discussed above, since the size of the magnetic isolation recess 133 can be provided differently, to form a different Φm2. While the electromagnetic attraction force F2 is generated by the composite magnetic flux (Φm2-Φc2), therefore, under a different Φm2, to reduce the electromagnetic attraction force F2 to a value smaller than the counter force F1, the value of Φc2 should be changed. Since Φc2 is generated by applying a voltage on the coil, changing the size of the magnetic isolation recess 133 will change the magnitude of Φm2, and in turn, change the magnitude of the resetting voltage for resetting the armature.

In the magnetic circuit of the present invention, in order to ensure a certain strength of the components, the magnetic conduction cross sectional area 1331 (as shown in FIG. 5) at either side of the magnetic isolation recess 133 of the yoke cannot be reduced infinitely. Therefore, Φm2 cannot be too large, and generally a small resetting voltage can be applied to obtain an electromagnetic attraction force F2, as generated by the composite magnetic flux (Φm2-Φc2), smaller than the counter force F1, to reset the armature. For a magnetic latching relay, it is desirable to make the resetting voltage to be approximate to the setting voltage as much as possible. Therefore, in order to increase the resetting voltage, in the prevent disclosure, half of the pole shoe of the iron core is cut off (according to a magnetic circuit principle, the smaller the area of the pole shoe of the iron core is, the larger the retention force (the magnetic attraction force F2) on the armature when the armature is at the setting position is, and the larger the resetting voltage required is), so as to balance the resetting voltage and the setting voltage (to make the resetting voltage to be approximate to the setting voltage in the value) as much as possible.

Figure 14:
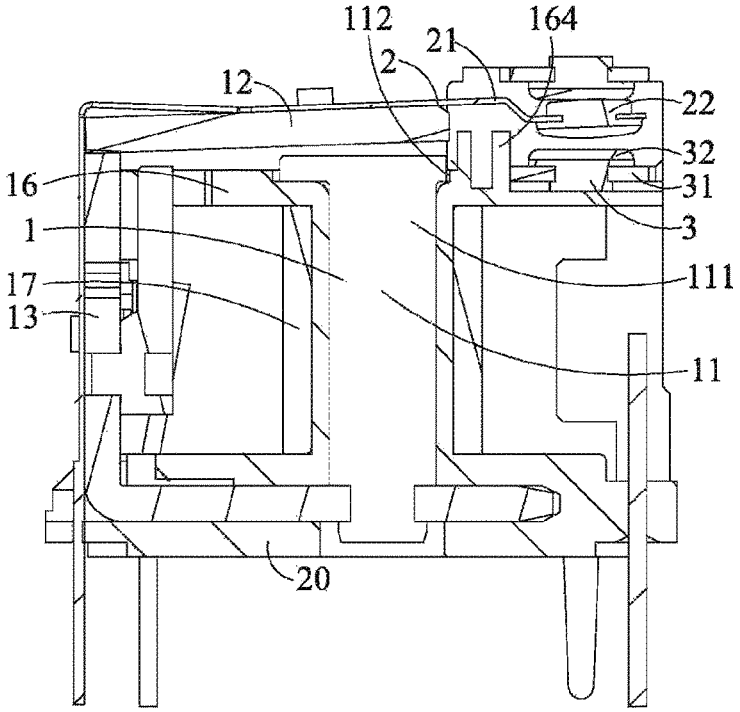
FIG. 14 is a cross sectional view of an embodiment of the present disclosure.
Figure 15:
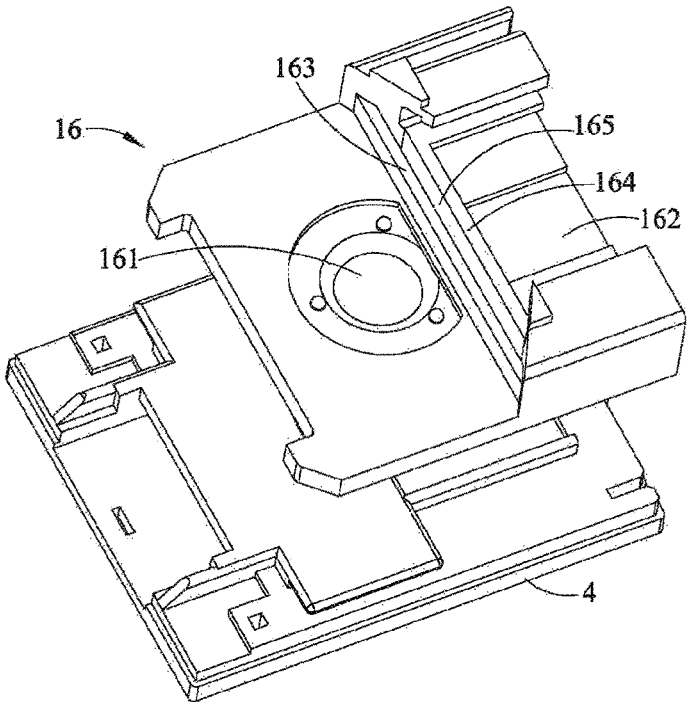
FIG. 15 is a schematic structural diagram of a coil rack according to an embodiment of the present disclosure, mainly showing an upper end plate.
Figure 16:
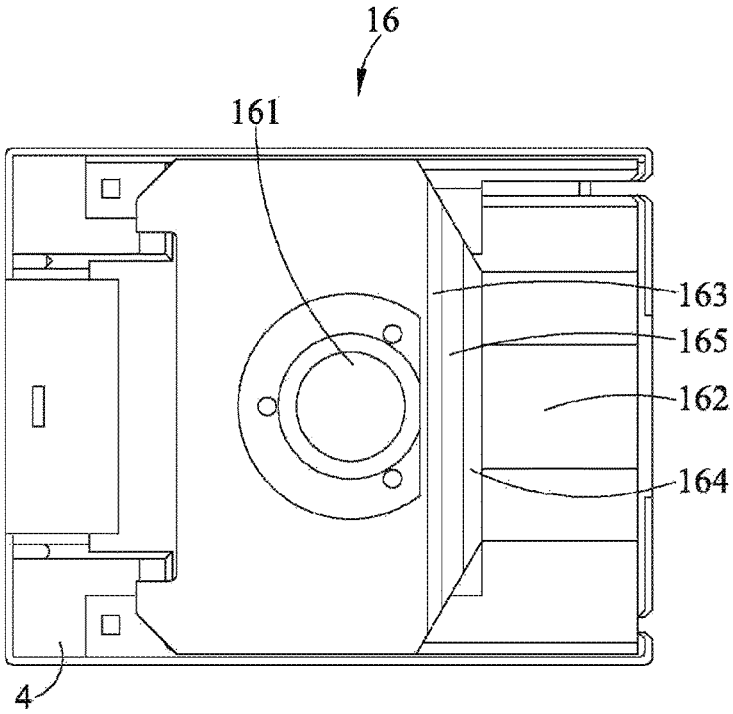
FIG. 16 is a top view of the coil rack according to an embodiment of the present disclosure, mainly showing an upper end plate.
Figure 17:
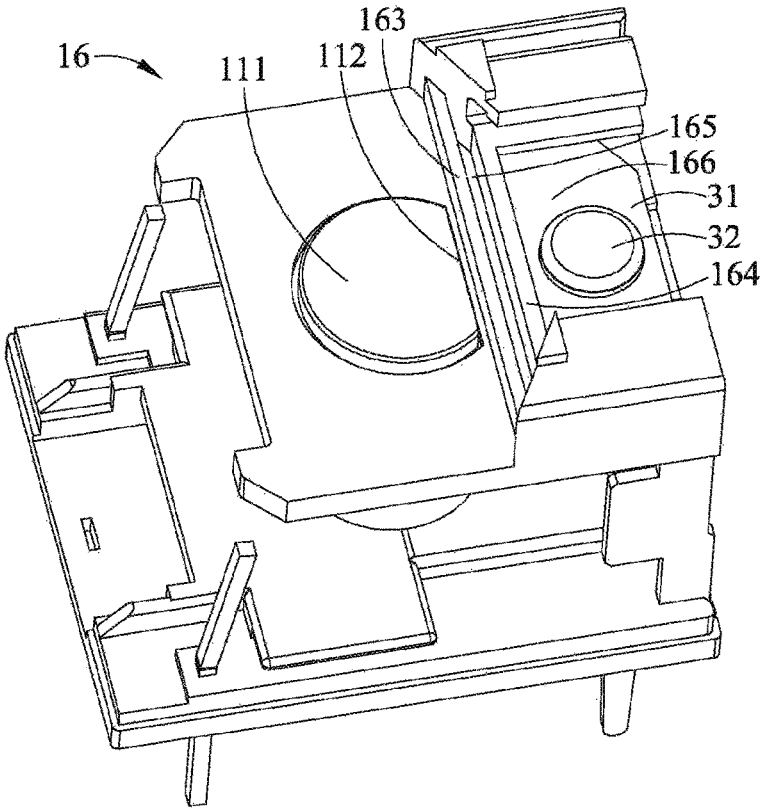
FIG. 17 is a schematic diagram of the coil rack according to an embodiment of the present disclosure, with an iron core and a fixed spring assembled.

An embodiment regarding the coil rack 16 and the fixed spring portion 3 in the relay will be described below. As shown in FIG. 2 and FIG. 14, the fixed spring portion 3 includes the fixed spring sheet 31 and the fixed contact point 32 fixed on the fixed spring sheet 31. The fixed spring sheet 31 is mounted at a position which allows the movable contact point and the fixed contact point to contact each other. The coil rack 16 includes an upper terminal plate 160, a bobbin 167 and a lower terminal plate 168. The upper terminal plate 160 of the coil rack 16 extends to a side, and a mounting portion 162 is disposed at the side. The fixed spring sheet 31 and the fixed contact point 32 are embedded in the mounting portion 162. The movable contact point 22 is mounted at a position in the mounting portion 162 where matches with the position of the fixed contact point 32 (as shown in FIGS. 15-17). At least one shielding wall 163, 164 is provided on the coil rack 16 and between the though hole 161 and the mounting portion 162. The shielding wall 163, 164 is formed as one piece with the coil rack 16, to separate the pole shoe 11 at the through hole of the coil rack and the fixed spring sheet 31 at the mounting portion.

Figure 18:
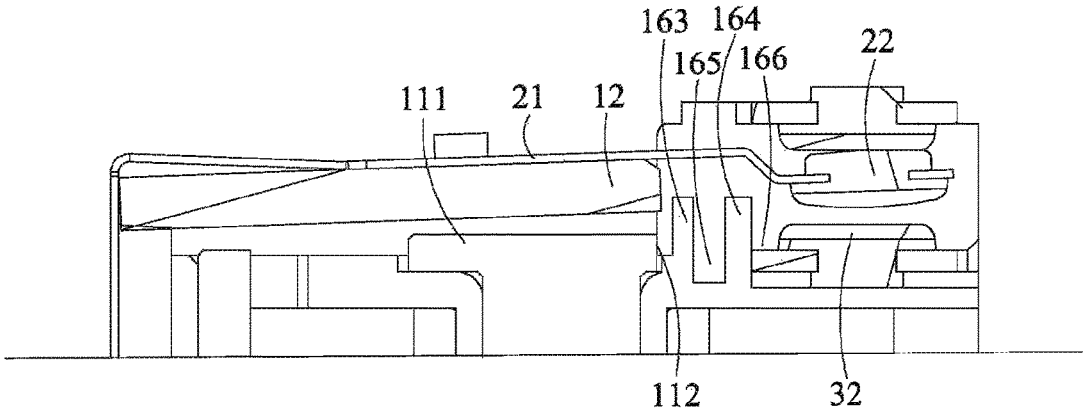
FIG. 18 is a partial structural diagram of an armature and contact mechanism according to an embodiment of the present disclosure.
Figure 19:
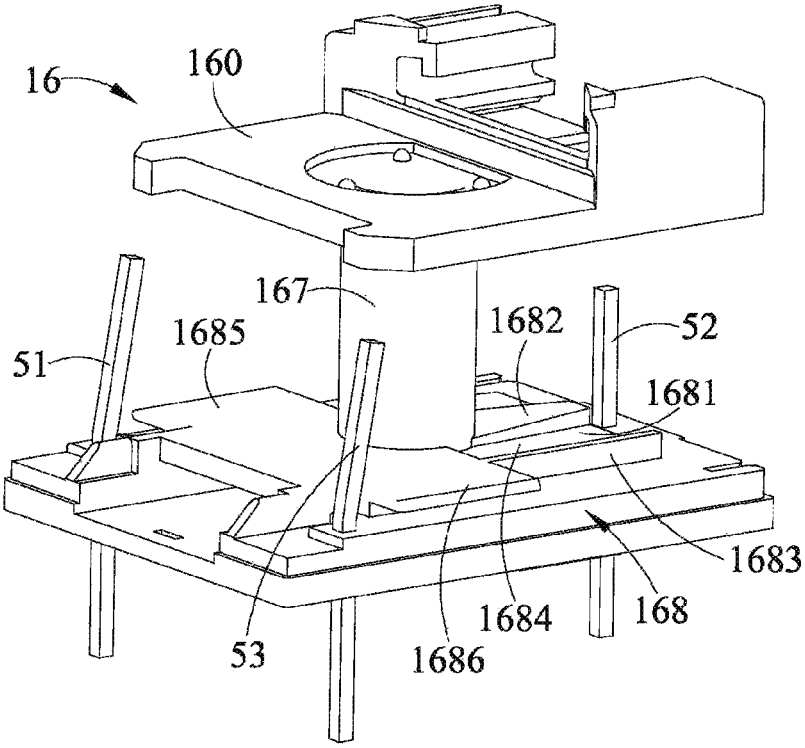
FIG. 19 is a perspective diagram of a coil rack according to an embodiment of the present disclosure.
Figure 20:
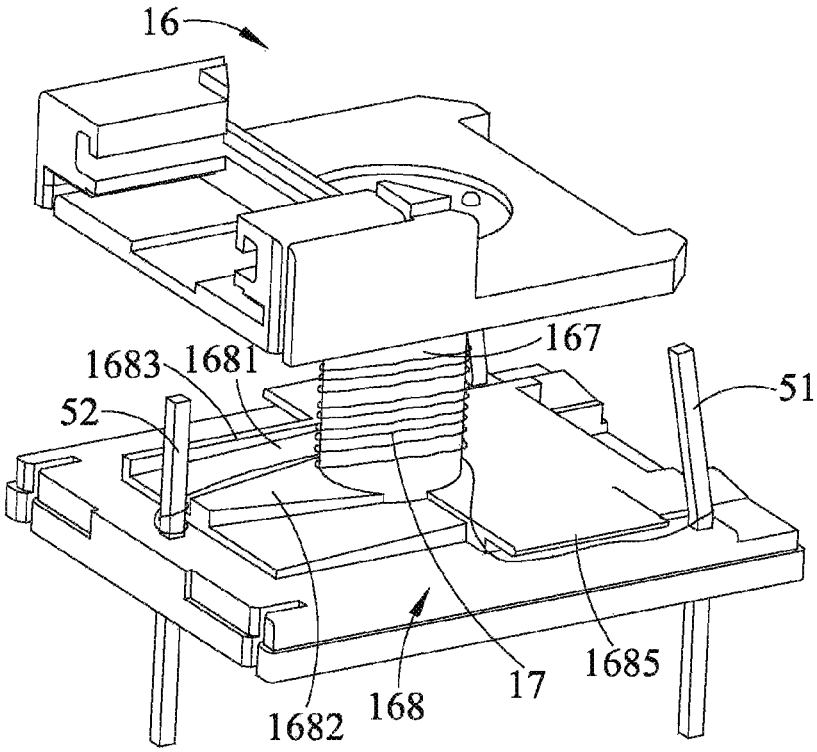
FIG. 20 is a schematic diagram of a coil rack when winding inner circles of an enameled wire according to an embodiment of the present disclosure.
Figure 21:
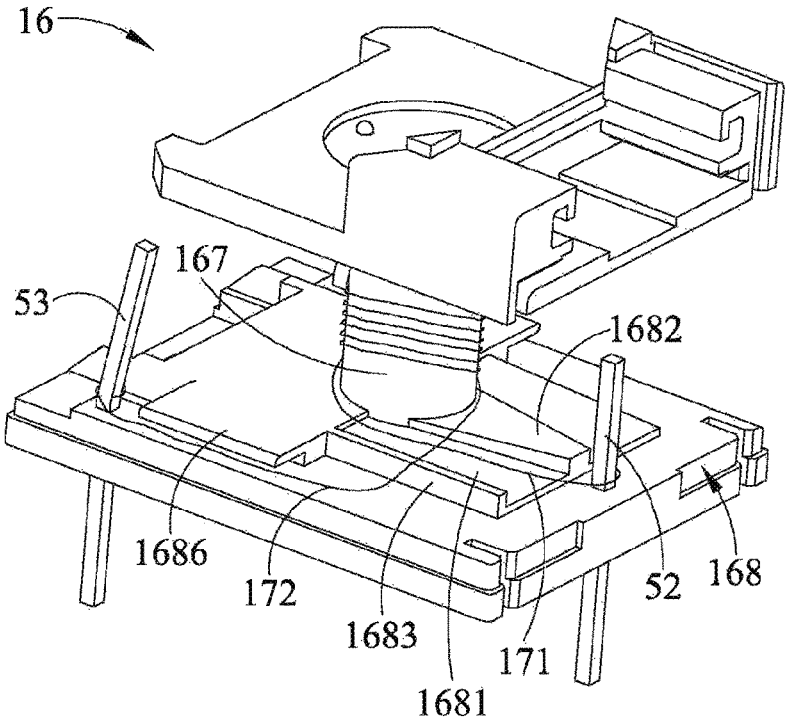
FIG. 21 is a schematic diagram of a coil rack when winding outer circles of an enameled wire according to an embodiment of the present disclosure.
Figure 22:
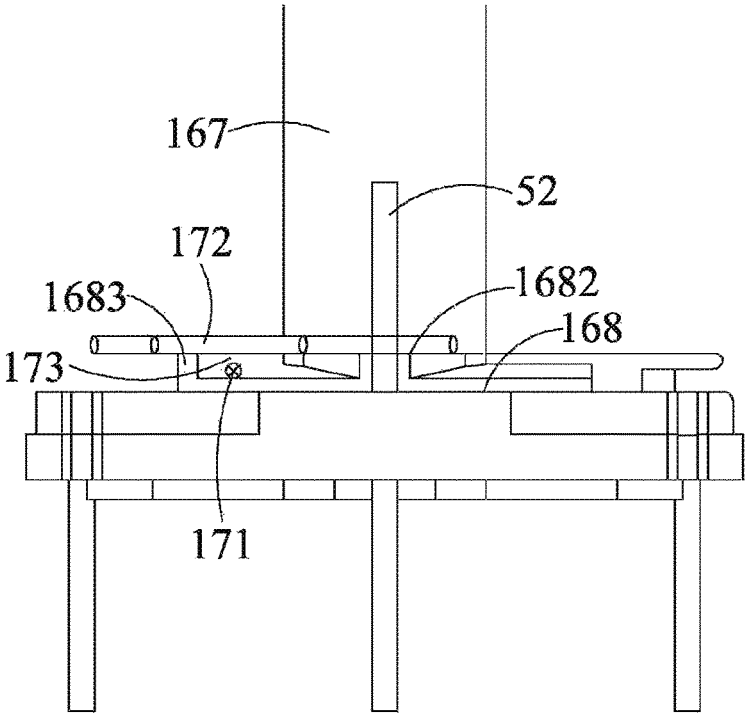
FIG. 22 is a side view of a coil rack when winding outer circles of an enameled wire according to an embodiment of the present disclosure.
Figure 23:
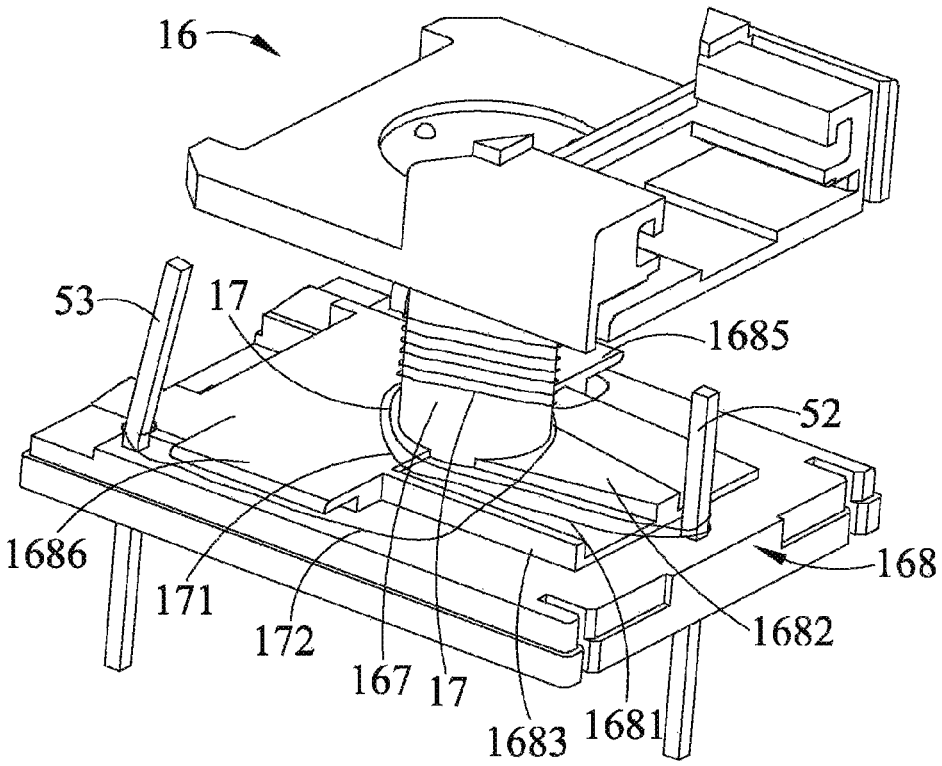
FIG. 23 is a schematic diagram of a coil rack when inner circles and outer circles of an enameled wire have been wound according to an embodiment of the present disclosure.

In the present embodiment, as shown in FIG. 14 and FIG. 18, there are two shielding walls 163 and 164. A groove 165 is formed between the shielding walls 163 and 164 to collect spatters of the contact points. Wherein one shielding wall 163 is disposed close to the through hole 161, and corresponding to the armature 12 of the movable spring sheet. The height of the shielding wall 163 is not lower than the bottom of the armature 12 when the relay is reset, in order to prevent the armature 12 from moving to the direction where the movable contact point contacts the fixed contact point.

There can be provided one shielding wall. When there is only one shielding wall, the shielding wall is disposed close to the through hole, and corresponding to the armature of the movable spring sheet. The height of the shielding wall is not lower than the bottom of the armature when the relay is reset, in order to prevent the armature from moving to the direction where the movable contact point contacts the fixed contact point.

A cut 112 is provided at a side of the pole shoe 111 where close to the fixed spring sheet 31. Thus, the creepage distance between the pole shoe and the fixed spring sheet is increased by a distance of the cut 112. Thereby, the creepage distance between the pole shoe of the iron core and the fixed spring sheet can be increased.

Also referring to FIGS. 15-17, shielding walls 163 and 164 are provided on the coil rack and between the fixed spring sheet 31 and the iron core 11. After the movable contact point and the fixed contact point are burned, metal spatters of the movable contact point and the fixed contact point can be blocked by the shielding wall, to prevent the metal spatters from drifting from the contact points to the iron core. The groove 165 formed between the two shielding walls and a region 166 between the shielding wall 164 and the fixed contact point 32 can also be configured to collect the metal spatters of the contact points. Thereby, the creepage distance between the movable contact point and the fixed contact point as well as the dielectric Strength can be improved, and it can effectively prevent electrical accidents caused by unwanted conduction of the movable contact point and the fixed contact point due to accumulation of metal spatters of the contact points. The shielding wall 163 is disposed close to the through hole 161, and corresponding to the armature 12 which is secured to the movable spring sheet. The height of the shielding wall 163 is not lower than the bottom of the armature 12 when the relay is reset. When the relay is subject to an impact in a length direction, the armature 12 will move toward the contact points. Due to the presence of the shielding wall 163, the armature 12 is limited in the length direction. Thus, the armature 12 and the movable contact point 22 will not displace from normal positions due to the impact, significantly improving the impact resistance of the relay. The above configuration can expand the application range of the relay.

As shown in FIGS. 19-23, an embodiment of the present disclosure provides a coil rack of a double-coil relay. One end of the bobbin 167 is connected to the upper terminal plate 160, the other end of the bobbin 167 is connected to the lower terminal plate 168. A first pin 51, a second pin 52 and a third pin 53 are respectively mounted on the lower terminal plate 168. The lower terminal plate 168 can be integrated with the base 4.

A groove 1684 is provided at an inner side of the lower terminal plate 168 between the bobbin 167 and the second pin 52, to guide the enameled wire. One end of the groove 1684 can be connected to the bobbin 167, and the other end of the groove can lead to the second pin 52. An inclined plate 1681 is provided at an inner side of the lower terminal plate 168, and located between the bobbin 167 and the second pin 52. The inclined plate 1681 is gradually inclined in a direction from the bobbin to the second pin. A boss 1682 extending from the bobbin to the second pin is provided in the middle of the inclined plate 1681. That is, the boss 1682 is provided on the inclined plate 1681, and the boss 1682 is a boss with a flat surface. A support wall 1683 is provided at a side of the inclined plate 1681. The support wall 1683 is also provided on the inclined plate 1681, and an upper surface of the support wall 1683 is also flat. The groove 1684 for guiding the enameled wire is surrounded and thus formed by the support wall 1683 and the boss 1682. The bottom of the groove 1684 is an inclined plate.

The height of the boss 1682 is the same as the height of the support wall 1683. However, the height of the boss 1682 can be different from the height of the support wall 1683.

A first cover plate 1685 which can press and seize the enameled wire is mounted at the inner side of the lower terminal plate 168 and between the first pin 51 and the bobbin 167. That is, the first cover plate 1685 is provided at the inner side of the lower terminal plate 168, and located between the bobbin 167 and the first pin 51.

In the present embodiment, the upper surface of the first cover plate 1685, the upper surface of the boss 1682 and the upper surface of the support wall 1683 are in the same horizontal plane. However, the upper surface of the first cover plate 1685 can also be disposed as higher than the upper surface of the boss 1682 and the upper surface of the support wall 1683.

A second cover plate 1686 which can press and seize the enameled wire is mounted at the inner side of the lower terminal plate 168 and between the third pin 53 and the bobbin 167. That is, the second cover plate 1686 is provided at the inner side of the lower terminal plate 168, and located between the bobbin 167 and the third pin 53.

In the present embodiment, the upper surface of the second cover plate 1686, the upper surface of the boss 1682 and the upper surface of the support wall 1683 are in the same horizontal plane. However, the upper surface of the second cover plate 1686 can also be disposed as higher than the upper surface of the boss 1682 and the upper surface of the support wall 1683.

As shown in FIGS. 20-23, the present embodiment provides a coil rack of a double-coil relay. To wind the enameled wire, the enameled wire are firstly wound from inner circles. After the enameled wire 17 is firstly wound on the first pin 51, the enameled wire 17 passes below the first cover plate 1685. After the enameled wire 17 is wound on the bobbin 167 anticlockwise for a required number of circles, the enameled wire 17 passes through the groove 1684 and leads to the second pin 52. After the enameled wire 17 is wound on the second pin 52, winding of the inner circles of the enameled wire 17 is completed. In winding of the outer circles, after the enameled wire 17 is wound on the second pin 52, a first circle 171 of the enameled wire passes through the groove 1684 and leads to the bobbin 167. After the enameled wire is wound on the bobbin 167 clockwise for a required number of circles, the last circle 172 of the enameled wire passes through the boss 1682, the support wall 1683 and leads to the below part of the second cover plate 1686. After the enameled wire passes through the below part of the second cover plate 1686, and is wound on the third pin 53, the winding of the outer circles is completed. The boss 1682 and the support wall 1683 form the groove 1684 which can guide the enameled wire; the bottom of the groove is an inclined plate; one end of the groove is connected to the bobbin; and the other end of the groove leads to the second pin. Thereby, in winding the first circle 171 of the outer circles of the enameled wire, the enameled wire is placed on the inclined plate 1681. In winding the last circle 172 of the outer circles of the enameled wire, due to the effect of the boss 1682 and the support wall 1683, the last circle 172 of the enameled wire can be held up, to form an air gap 173 between the first circle 171 of the enameled wire and the last circle 172 of the enameled wire, thus avoiding an unfavorable situation of the first circle and the last circle being directly placed together in winding the out circles.

The above is an embodiment of the coil rack 16, and is not exclusively applied to the above magnetic latching relay with a paralleltype magnetic circuit. The coil rack 16 can also be applied in other types of relays by those skilled in the art.

Although the present disclosure has been described with reference to some exemplary embodiments, it should be understood that the terms are not restrictive, but illustrative and exemplary. The present disclosure can be embodied in various forms without departing from the spirit or essence thereof. Therefore, it can be understood that the above embodiment is not limited to the above details, but should be interpreted broadly within the spirit and scope defined by the appending claims. In this regard, all alterations and modifications falling within the claims or their equivalent scope should be covered by the appending claims.

What is claimed is:

1. A magnetic latching relay of a parallel type magnetic circuit, comprising a magnetic circuit portion and a movable spring portion, characterized in that, the magnetic circuit portion comprises an iron core, an armature, an iron yoke, a permanent magnet, a magnetic conductor member, a coil and a coil rack wherein the coil rack comprises;

a bobbin, one end of the bobbin is provided with a first terminal plate, a first pin, a second pin and a third pin are respectively mounted on the first terminal plate, characterized in that, a groove for guiding an enameled wire is provided at an inner side of the first terminal plate and between the bobbin and the second pin, one end of the groove is connected to the bobbin, the other end of the groove is connected to the second pin;

the iron yoke is L shaped, formed by a first yoke parallel to the iron core and a second yoke perpendicular to the iron core; the coil is wound on the coil rack, the iron core passes through the coil rack, a lower end of the iron core is secured to the second yoke; the armature is movably mounted to a hinge portion of the iron yoke, an air gap is formed between one end of the armature and an upper end of the iron core; one end of the magnetic conductor member is connected to the first yoke, the other end of the magnetic conductor member is connected to first yoke through the permanent magnet;

a magnetic isolation portion is provided on the first yoke which is between a joint of the first yoke and the permanent magnet and a joint of the first yoke and the magnetic conductor member, the magnetic isolation portion is configured to increase a magnetic resistance of the magnetic circuit portion, and to adjust balance between magnitudes of setting voltage and resetting voltage of the relay;

the movable spring portion comprises a movable spring sheet and a movable contact point, the movable spring sheet formed with a first side and a second side, an elastically bendable angle is formed between the first side and the second side; the armature is secured to the second side, the first yoke is secured to the first side, the armature is flexibly connected to the first yoke via the movable spring sheet; the movable contact point is secured to the second side, wherein the permanent magnet and the magnetic conductor member, the first yoke, the second yoke, the iron core and the armature form two parallel permanent magnetic paths; the coil and the iron core form a control magnetic path, to control the opening and closing of the air gap; the permanent magnetic paths provide a force to maintain the air gap to be closed; the movable spring sheet provides a counter force to maintain the air gap to be opened.

2. The magnetic latching relay of a parallel type magnetic circuit of claim 1, characterized in that, the magnetic isolation portion is at least one magnetic isolation recess configured to increase the magnetic resistance of the magnetic circuit portion, an opening size of the magnetic isolation recess can be adjusted to regulate balance between magnitudes of a setting voltage and a resetting voltage of the relay.

3. The magnetic latching relay of a parallel type magnetic circuit of claim 2, characterized in that, an upper end of the iron core is provided with a pole shoe, a cut is provided at a side of the pole shoe, a size of the cut and/or the opening size of the magnetic isolation recess can be adjusted to regulate balance between magnitudes of a setting voltage and a resetting voltage of the relay.

4. The magnetic latching relay of a parallel type magnetic circuit of claim 1, characterized in that, one end of the magnetic conductor member is provided with a contact surface for contacting the first yoke.

5. The magnetic latching relay of a parallel type magnetic circuit of claim 4, characterized in that, the contact surface of the magnetic conductor member is provided with a boss for positioning with the first yoke, the first yoke is provided with a hole for fitting with the boss of the magnetic conductor member; the boss of the magnetic conductor member is fitted in the hole of the first yoke, and secured thereto via rivet or welding.

6. The magnetic latching relay of a parallel type magnetic circuit of claim 4, characterized in that, the permanent magnet is secured to the other end of the magnetic conductor member, and the other end of the magnetic conductor member is provided with a bulge for securing the permanent magnet.

7. The magnetic latching relay of a parallel type magnetic circuit of claim 1, characterized in that, the relay further comprises a fixed spring portion, the fixed spring portion comprises a fixed spring sheet and a fixed contact point secured on the fixed spring sheet; an upper end plate of the coil rack extends to a side where a mounting portion is disposed, the fixed spring sheet is mounted in the mounting portion, the movable contact point is mounted at a position in the mounting portion where matches with the position of the fixed contact point; at least one shielding wall is provided on the coil rack and between the through holes and the mounting portion, to separate a pole shoe at the through hole of the coil rack and the fixed spring sheet at the mounting portion.

8. The magnetic latching relay of a parallel type magnetic circuit of claim 7, characterized in that, there is provided one shielding wall, the shielding wall is disposed close to the through hole, and corresponding to the armature secured to the movable spring sheet, a height of the shielding wall is not lower than a bottom of the armature when the relay is reset, in order to prevent the armature from moving to a direction where the movable contact point contacts the fixed contact point.

9. The magnetic latching relay of a parallel type magnetic circuit of claim 7, characterized in that, there are provided two shielding walls, and a groove is formed between the two shielding walls for collecting spatters of the contact points, wherein one of the shielding walls is disposed close to the through hole, and corresponding to the armature secured to the movable spring sheet, a height of the shielding wall is not lower than a bottom of the armature when the relay is reset, in order to prevent the armature from moving to a direction where the movable contact point contacts the fixed contact point.

10. The magnetic latching relay of a parallel type magnetic circuit of claim 7, characterized in that, the shielding wall is integrated with the coil rack.

11. The magnetic latching relay of a parallel type magnetic circuit of claim 1, characterized in that, a boss is provided at the inner side of the first terminal plate, the boss extending from the bobbin to the second pin, one side of the boss is provided with a support wall, and the groove for guiding an enameled wire is surrounded and thus formed by the support wall and the boss.

12. The coil rack of a double-coil relay of claim 1, characterized in that, an inclined plate is provided at the inner side of the first terminal plate, the inclined plate is gradually inclined in a direction from the bobbin to the second pin; the boss and the support wall are respectively disposed at the middle of the inclined plate and at a side of the inclined plate.

13. The coil rack of a double-coil relay of claim 1, characterized in that, a first cover plate which can press and seize the enameled wire is mounted at the inner side of the first terminal plate and between the first pin and the bobbin.

14. The coil rack of a double-coil relay of claim 13, characterized in that, neither of an upper surface of the boss and an upper surface of the support wall is higher than an upper surface of the first cover plate.

15. The coil rack of a double-coil relay of claim 1, characterized in that, a second cover plate which can press and seize the enameled wire is mounted at the inner side of the first terminal plate and between the third pin and the bobbin.

16. The coil rack of a double-coil relay of claim 15, characterized in that, neither of an upper surface of the boss and an upper surface of the support wall is higher than an upper surface of the second cover plate.

* * * * *